United States Patent [19]

Bard

[11] 3,955,722

[45] May 11, 1976

[54] NEEDLEWORK FRAME SUPPORT STAND

[76] Inventor: Donald I. Bard, 7901 College Lane, Annandale, Va. 22003

[22] Filed: July 16, 1975

[21] Appl. No.: 596,534

[52] U.S. Cl. ..... 223/106; 223/120; 38/102.2; 248/125

[51] Int. Cl.[2] ..... A41H 31/00

[58] Field of Search ..... 223/106, 107, 120; 38/102.2, 102.1; 248/125, 295, 316 C

[56] References Cited

UNITED STATES PATENTS

| | | | |
|---|---|---|---|
| 1,016,463 | 2/1912 | Wilkins | 38/102.2 |
| 3,151,789 | 10/1964 | Schatz | 223/106 |
| 3,178,144 | 4/1965 | Kimoto | 248/125 X |
| 3,906,648 | 9/1975 | Bard | 38/102.2 |

*Primary Examiner*—George H. Krizmanich
*Attorney, Agent, or Firm*—A. Yates Dowell, Jr.

[57] ABSTRACT

Apparatus for supporting a fancy needlework frame in a convenient position which is readily accessible to a craftsman sitting or reclining in a chair, bed or the like. The apparatus includes a baluster column mounted on a base and a thread supply supporting structure mounted at the upper end. An adjusting block is slidably and rotatably mounted on the upper portion of the column and adjustably receives a support member which carries the fancy needlework frame.

5 Claims, 6 Drawing Figures

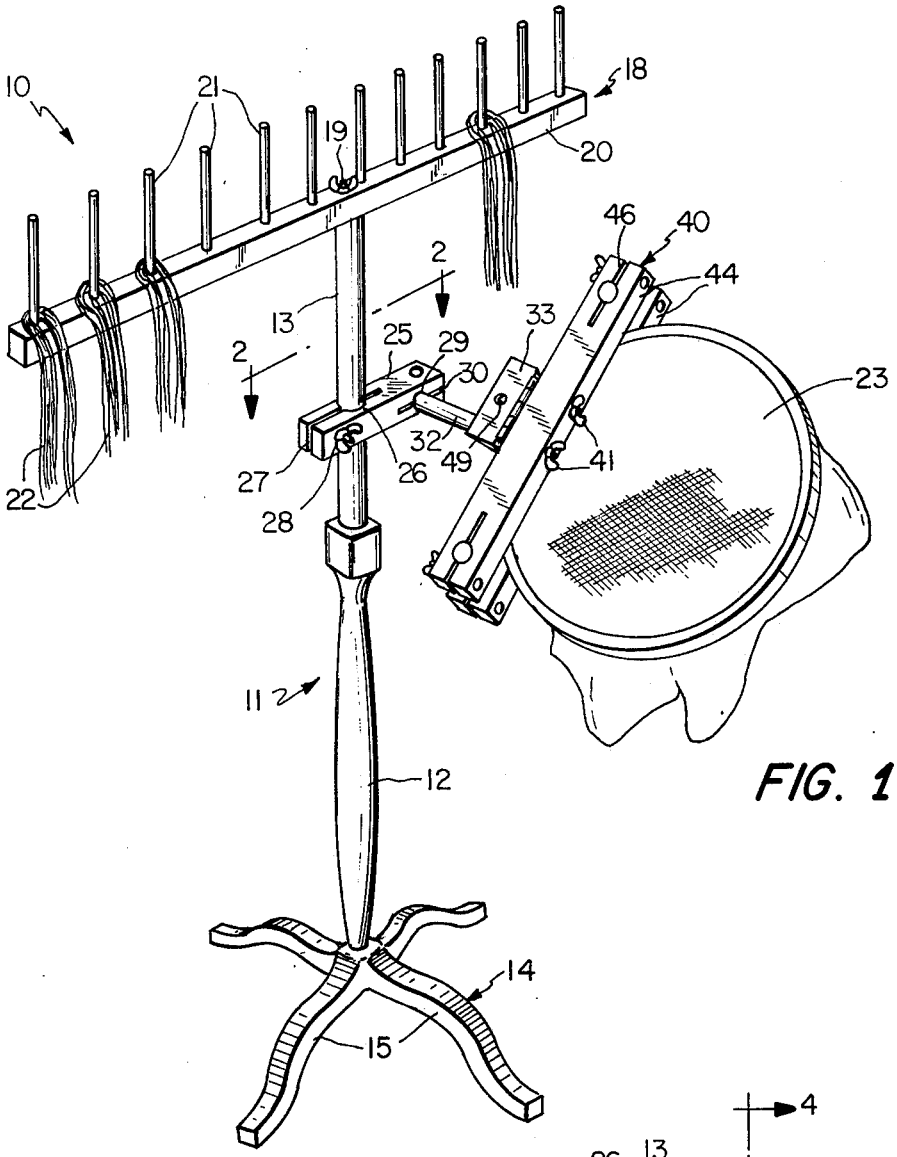
FIG. 1
FIG. 6
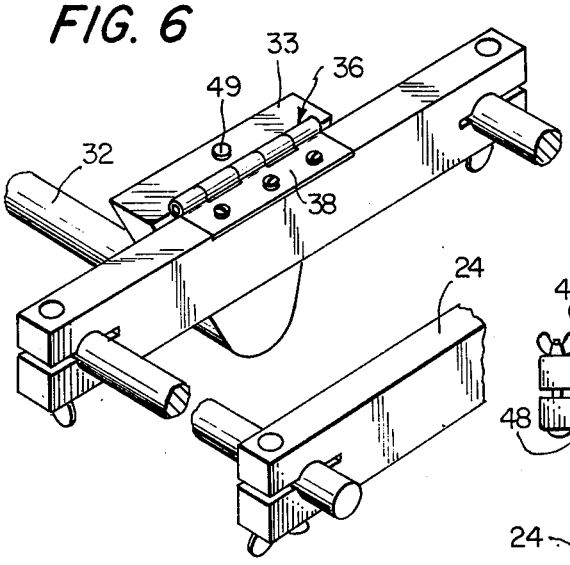
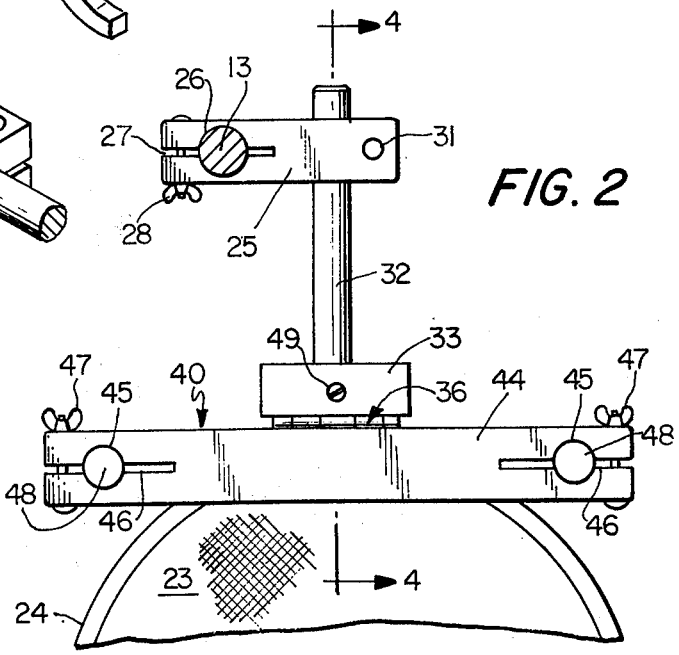
FIG. 2

FIG. 3
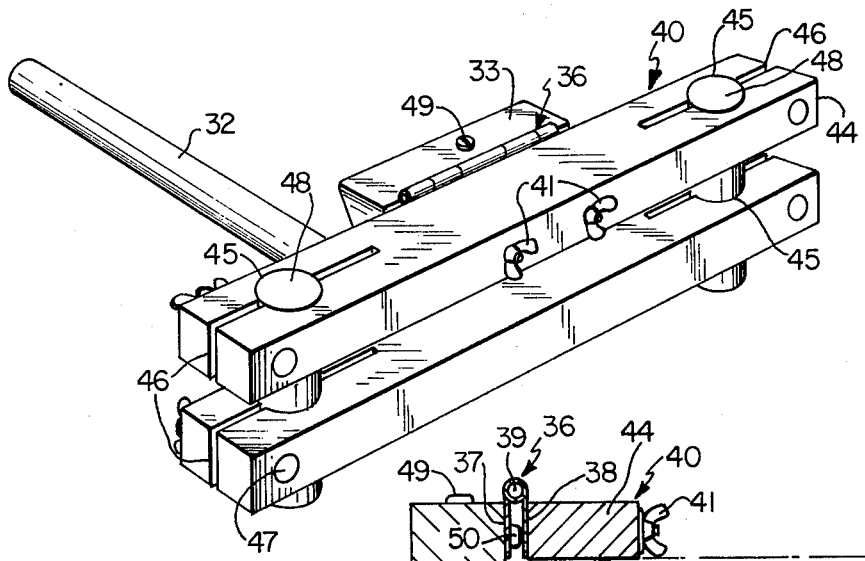
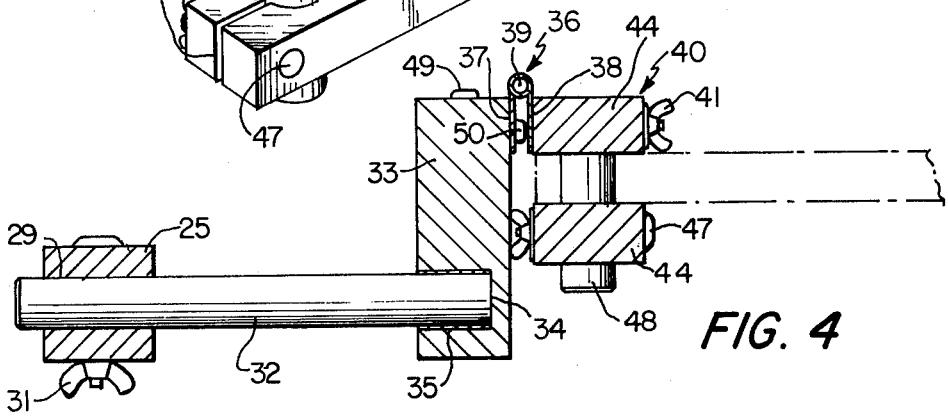
FIG. 4
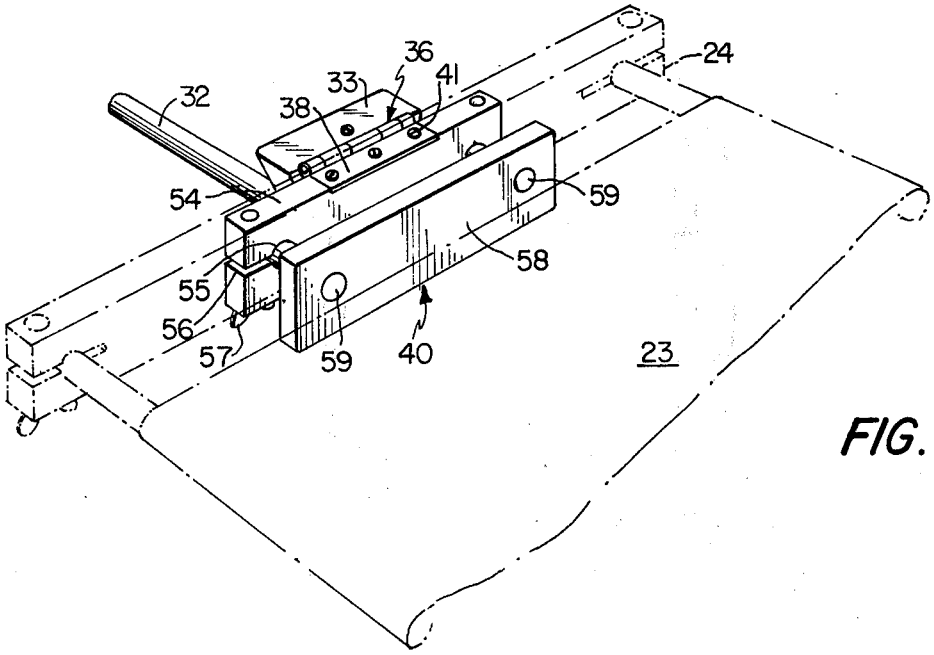
FIG. 5

NEEDLEWORK FRAME SUPPORT STAND

BACKGROUND OF THE INVENTION

1. Field of the Invention

This invention relates generally to support structures of various kinds and relates particularly to furniture type apparatus for supporting a fancy needlework frame in a position which is readily accessible to a person sitting or reclining in a chair, bed or the like.

2. Description of the Prior Art

Heretofore many efforts have been made to provide a support for a fancy needlework frame on which a base material of woven or unwoven cloth was mounted so that the frame and base material were easily accessible to a craftsman. By supporting the frame and the base material, which usually included a pattern, the craftsman could use both hands to make the stitches and knots normally associated with needlepoint, embroidery, crewel and the like. Many of these prior art structures have been clamped to the edge of a table or to the frame of a bed or other more or less fixed structure so that the needlework frame support structure was not easily portable. Other prior art structures, including applicant's copending application for Fancy Stitchery Working Frame Support, Ser. No. 502,683, have been provided and have included one or more posts mounted on a base; however, most of these prior art structures have been complicated and expensive to produce and maintain and in many of the structures it has been necessary to provide a pair of posts arranged in such a manner that the fancy needlework frame was located between such posts so that both ends of the frame were supported. Also, in order to provide the necessary movements and provide places for supporting yarn and other accoutrements, the resulting structure has been offensive to the aesthetic values of a person and, therefore, ordinarily have been relegated to workrooms and the like where they were out of sight.

Additionally some efforts have been made to provide a fancy stitchery needlework frame support, including applicant's copending application Ser. No. 534,496, which included a base which was placed on a chair, bed or the like and on which the craftsman sat to provide a firm foundation for an upright post on which the fancy needlework frame was mounted.

Some additional examples of the prior art are disclosed in the U.S. Pat. Nos. to Elder 308,406; Haley 575,710; Bosler 699,263; Binger 1,733,001; and Wilson 3,309,803; German Pat. No. 91,076 of 1897; Austrian Pat. No. 983 of 1899; and Italian Pat. No. 412,998 of 1946.

SUMMARY OF THE INVENTION

The present invention is embodied in a decorative aesthetically pleasing stand for supporting a fancy stitchery working frame in a position readily accessible to a craftsman who is either sitting or reclining. The stand includes a baluster column having a decorative functional base at one end and a thread supply supporting structure at the opposite end. An adjusting block is slidably and rotatably mounted on the upper portion of the column and such block slidably and rotatably receives a rod member on which an anchor block is mounted. In one embodiment, a working frame support clamp member is hingedly mounted on the anchor block and such clamp member is adapted to removably receive a working frame such as an embroidery hoop or a tapestry frame in such a manner that the craftsman is free to use both hands in making the fancy stitches and knots normally associated with needlepoint, embroidery, crewel and the like. In this embodiment, the working frame is easily removable from the clamp member so that the position of the working frame can be shifted and then reclamped. In another embodiment, the working frame is directly attached to the hinge carried by the anchor block to permit swinging movement of the working frame, however, such frame is not easily shiftable.

It is an object of the invention to provide a functional aesthetically pleasing needlework frame support stand which can be easily adjusted to any angular or rotational position relative to a craftsman who is in either a sitting or reclining position.

BRIEF DESCRIPTION OF THE DRAWINGS

FIG. 1 is a perspective illustrating one application of the invention.

FIG. 2 is an enlarged fragmentary section on the line 2—2 of FIG. 1.

FIG. 3 is an enlarged perspective of a working frame support clamp member for use with embroidery hoops and the like.

FIG. 4 is an enlarged section on the line 4—4 of FIG. 2.

FIG. 5 is a perspective similar to FIG. 3 illustrating a modified form of clamp member for use with a tapestry frame.

FIG. 6 is an enlarged perspective of another embodiment in which the working frame is mounted directly on the hinge carried by the anchor block.

DESCRIPTION OF THE PREFERRED EMBODIMENTS

With continued reference to the drawings, a needlework frame support stand 10 is provided having an upright aethetically pleasing baluster column 11 defined by a vaselike curved lower portion or spindle 12 and a generally cylindrical upper portion 13. The lower end of the column 11 is fixed to a base member 14 which can be of any desired construction, although a plurality of outwardly extending legs 15 disposed at an angle to each other has been found particularly attractive and functional.

A thread supply supporting structure 18 is mounted on the upper end of the column 11 in any desired manner, as by a bolt and wing nut or other fastener 19 and such thread supply support structure includes a generally horizontally disposed arm 20 having a plurality of upstanding pins or fingers 21 mounted thereon. A supply of precut threads or yarns 22 is supported by each of the fingers 21. Normally each finger supports a different colored thread in a manner such that all of the threads of one color are gathered together and are merely looped around one of the fingers so that the ends of the threads hang downwardly. The threads are of a desired size, weight and color in accordance with the particular pattern printed on the base material 23 carried by the needlework working frame 24. The working frame 24 is of conventional construction and includes structures such as embroidery hoops shown in FIG. 1 and tapestry or rug frames shown in FIG. 6 and in phantom in FIG. 5.

An adjusting block 25 is provided with a vertically extending bore 26 adjacent to one end of a size to slidably receive the upper portion 13 of the column 11 and such bore communicates with a slit 27 which bifurcates one end of the adjusting block. A horizontally extending bolt and wing nut or other adjustable fastener 28 is located between the bore 26 and the end of the adjusting block and is arranged in a manner to cause the bifurcations to move toward each other when the fastener is tightened to clamp the adjusting block onto the upper portion 13 of the column. Adjacent to the other end, the adjusting block 25 is provided with a horizontally extending bore 29 and such horizontal bore communicates with a slit 30 which bifurcates the opposite end of the adjusting block. A vertically extending bolt and wing nut or other adjustable fastener 31 is located between the bore 29 and the end of the adjusting block and causes the bifurcations to move toward each other. The horizontal bore 29 is of a size to slidably receive an elongated dowel rod 32 which can be moved axially and rotationally when the fastener 31 is loose but which is clamped in fixed adjusted position when the fastener is tightened.

An anchor block 33 is provided having a recess 34 adjacent to its lower end and such recess snugly receives the end of the dowel rod 32 and is fixed thereto in any desired manner, as by adhesive 35. The upper end of the anchor block 33 is provided with a hinge member 36 having a pair of leaves 37 and 38 connected by a hinge pin 39. The hinge leaf 37 is fixed to the anchor block 33 in any desired manner, as by screws, adhesives or the like, and the leaf 38 is removably connected to a clamp member 40 by bolts and wing nuts 41 or other selectively removable fasteners.

With particular reference to FIGS. 1–4, the clamp member 40 includes a pair of elongated bars 44 which are similar to the side bars of a tapestry working frame. Each of the bars includes a bore 45 adjacent to each end and each bore communicates with a slit 46 which bifurcates the end of the bar. An adjustable fastener 47 is disposed between the bores 45 and the ends of the bar and connects such bifurcated ends. The elongated bars 44 are arranged in spaced generally parallel relationship with each other with the bores 45 in axial alignment. A relatively short dowel rod 48 is adjustably clamped in each of the aligned bores by the fasteners 47 so that one of the fasteners at each end of the bars 44 may be loosened after which the bars may be moved toward and from each other to clamp a working frame 24 therebetween.

In the embodiment shown in FIGS. 1–4, the elongated bars 44 are disposed one above the other so that an embroidery hoop or the like may be clamped between such bars and extend outwardly therefrom. In this position, the pattern on the base material 23 is exposed to the craftsman who is free to use both hands in making the complicated stitches associated with fancy needlework. If desired, the bolt and wing nut 31 may be loosened and the dowel rod 32 may be adjusted toward or away from the adjusting block 25 and may be rotated to position the clamp member 40 and the working frame 24 at an angle which is comfortable to the craftsman. After the craftsman has completed the use of a particular color thread or yarn 22, the clamp member 40 and the working frame 24 are swung upwardly about the hinge pin 39 to expose the bottom of the base material so that the craftsman may tie a knot to hold the thread. Also, when a specific portion of the pattern has been completed, the clamp member 40 may be loosened so that the working frame may be repositioned. As illustrated best in FIG. 4, a pair of adjustable stop members 49 and 50 are provided to stop and adjust the position of the clamp member 40 relative to the anchor block 33.

With particular reference to FIG. 5, another embodiment of the clamp member 40 is provided which is particularly useful with a tapestry type of working frame 24. In this embodiment an elongated bar 54 is provided having a bore 55 adjacent each end and each of such bores communicates with a slit 56 which bifurcates the end of the bar 54. An adjustable fastener 57 extends across the bifurcations of the bar 54, as previously described. An adjusting plate 58 is provided having a pair of spaced generally parallel dowel rods 59 connected thereto in any desired manner, as by an adhesive or the like, and such dowel rods are spaced apart a distance corresponding to the distance between the bores 55 and are adjustably received therein.

The hinge leaf 38 of the hinge member 36 is connected by screws or other fasteners to the top of the elongated bar 54 and the adjusting plate 58 is spaced from the elongated bar 54 a distance generally corresponding to the thickness of the side bars of the tapestry working frame 24. In this embodiment either end of the tapestry working frame can be clamped between the bar 54 and the plate 58 so that the craftsman can use both hands to work on the base material 23 carried by the working frame. However, such working frame may be easily removed from the clamp member and turned end for end so that the other side bar may be inserted within the clamp member and frictionally held therein. This is important when making fancy stitches which extend in both right and left-hand directions.

With particular reference to FIG. 6, another embodiment of the invention is disclosed in which one of the side bars of the working frame 24 is directly connected to the hinge leaf 38 by screws or other fasteners. In this embodiment the working frame may be swung upwardly to expose the bottom of the base material for the purpose of making knots in the thread. However, since the clamp member 40 has been eliminated, the working frame is not easily reversed end for end.

In the operation of the device, the support stand is positioned adjacent to a chair or bed on which a craftsman is located and the adjusting block 25 is moved up or down the upper portion 13 of the baluster column to a desired height for a particular craftsman. The anchor block 33 then is adjusted relative to the adjusting block so that the working frame 24 carried thereby is at a desired angle and positioned where the working frame is readily accessible to the craftsman. The craftsman then removes a thread or yarn of a desired color from the thread supply support structure 18 and connects such thread to a thread applying member such as a needle or the like and the craftsman stitches the thread onto the base material 23. When it is desired to change the color of the thread being used, the craftsman merely swings the working frame upwardly about the hinge member 36 carried by the anchor block 33 to expose the bottom of the base material so that the craftsman can knot the thread and cut the unused portion which is then returned to the appropriate pin of the thread supply support structure.

In the embodiment illustrated in FIGS. 1–4, when a particular portion of the pattern has been completed, or when the craftsman desires to work on a different section of the base material, the clamp member 40 is loosened and the working frame is removed therefrom and rotated to position another section of the base frame in a convenient location for the craftsman, after which the clamp member 40 is tightened to hold the working frame in the adjusted position.

Due to the gracefulness and simplicity of the needlework frame support stand, such stand is aesthetically pleasing and therefore the craftsman may leave the stand in a living room or other area where it is readily available and can be used to display the fancy needlework which has been completed or which is in the process of being completed.

I claim:

1. Apparatus for supporting a fancy needlework frame in a position convenient to a craftsman comprising a baluster column having a vaselike curved lower portion and a generally cylindrical upper portion, a base member fixed to one end of said lower portion, a thread supply supporting structure carried by said upper portion, said thread supply supporting structure including a plurality of upstanding pin means around which different colored threads are draped, an adjusting block slidably and rotatably mounted on the upper portion of said column, means for securing said adjusting block in fixed adjusted position on said column, dowel rod means slidably and rotatably mounted within said adjusting block, means for fixing said dowel rod means in adjusted position relative to said adjusting block, an anchor block carried by said dowel rod means, a hinge having a first portion mounted on said anchor block and a second portion movable relative thereto, and means for connecting the second portion of said hinge to a fancy needlework frame, whereby said adjusting block may be fixed in a selected position on the upper portion of said column and said anchor block is slidably and rotatably adjusted relative to said adjusting block to locate the working frame in a position convenient to a craftsman.

2. The structure of claim 1 in which said means for connecting said hinge to a fancy needlework frame includes a clamp member having first and second portions adjustably mounted for movement toward and from each other for clamping a portion of the working frame therebetween.

3. The structure of claim 2 in which said clamp member includes a pair of elongated bars, each of said bars having a bore at each end located in alignment with a bore in the other bar, rod means disposed within the aligned bores at each end of said bars, and means for clamping each of said bars to said rod means.

4. The structure of claim 2 in which said clamp member includes an elongated bar having a bore adjacent to each end, an adjusting plate located generally parallel with said elongated bar, said adjusting plate having a pair of outwardly extending rods receivable within the bores of said elongated bar and means on said bar for clamping said rods in fixed adjusted position within said bores.

5. A fancy needlework frame support stand comprising a baluster column having a vaselike curved lower portion and a generally cylindrical upper portion, a plurality of outwardly extending legs connected to said lower portion and forming a base for said column, a thread supply supporting structure mounted on said upper portion of said column, said thread supply supporting structure including an elongated generally horizontally disposed arm having a plurality of upwardly extending fingers, an adjusting block having a vertically disposed bore adjacent to one end and a horizontally disposed bore adjacent to the other end, one of the bores of said adjusting block being of a size to slidably and rotatably receive the upper portion of said column, means for securing said adjusting block in adjusted position on said column, an elongated rod slidably and rotatably received within the other bore of said adjusting block, means on said adjusting block for securing said rod in adjusted position, an anchor block fixed to one end of said rod, a clamp member hingedly mounted on said anchor block, said clamp member including a pair of spaced generally parallel clamping portions and means for connection said clamping portions together in fixed adjusted position, whereby a fancy stitchery working frame may be clamped by said clamp member and located in a selected position convenient to a craftsman.

* * * * *